United States Patent [19]

Dignard et al.

[11] Patent Number: 4,662,630

[45] Date of Patent: May 5, 1987

[54] MARTIAL ARTS STRIKING APPARATUS

[76] Inventors: Michael J. Dignard, 932 Curtis Ave., West Belmar, N.J. 07719; Paul C. Roberts, 650 McClellan St., Long Branch, N.J. 07740

[21] Appl. No.: 778,077

[22] Filed: Sep. 20, 1985

[51] Int. Cl.[4] ..... A63B 69/00

[52] U.S. Cl. ..... 272/76; 272/78

[58] Field of Search ..... 272/76, 77, 78, 93, 272/135, 136; 273/55 R

[56] References Cited

U.S. PATENT DOCUMENTS

| | | | |
|---|---|---|---|
| 992,868 | 5/1911 | Gorman | 272/78 |
| 2,253,758 | 8/1941 | Bulloch | 272/76 |
| 3,427,021 | 2/1969 | Donato | 272/76 |
| 3,501,143 | 3/1970 | Guhrin | 272/136 X |
| 4,491,316 | 1/1985 | Prence | 272/78 |

FOREIGN PATENT DOCUMENTS

| | | | |
|---|---|---|---|
| 1526964 | 4/1968 | France | 272/76 |

*Primary Examiner*—Richard J. Apley
*Assistant Examiner*—S. Welsh
*Attorney, Agent, or Firm*—R. Gale Rhodes, Jr.

[57] ABSTRACT

Martial arts striking apparatus including a striking board and mounting apparatus for mounting the striking board at different vertical heights and at different angles with respect to the vertical and for mounting the striking board resiliently whereby the board will pivot in response to a received blow and will thereafter be returned to its initial position.

8 Claims, 18 Drawing Figures

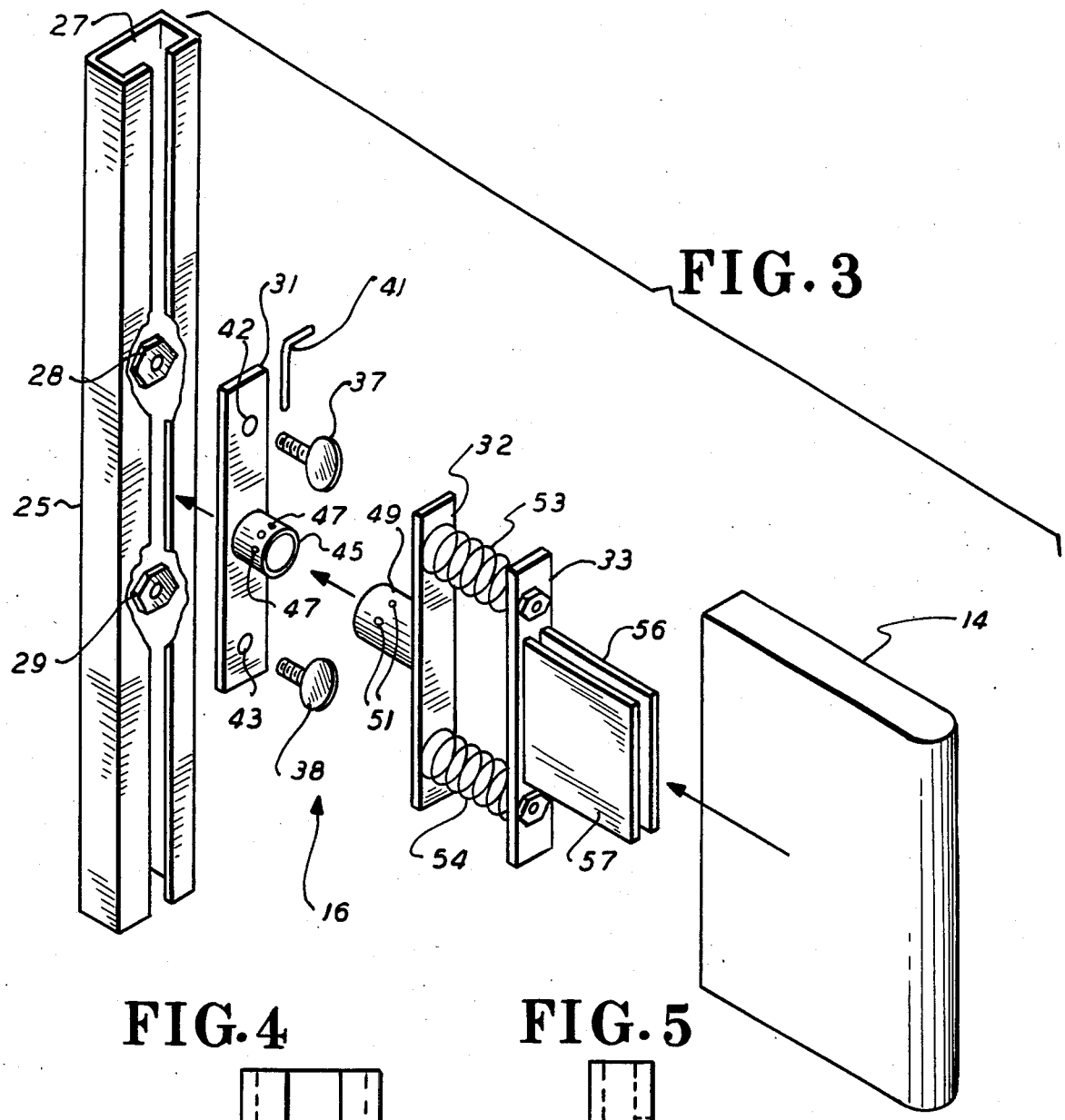
FIG. 3
FIG. 4
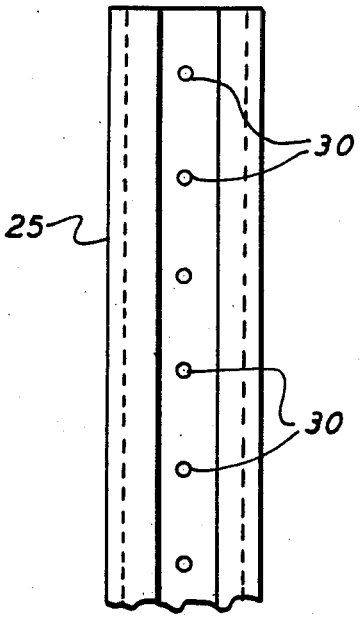
FIG. 5
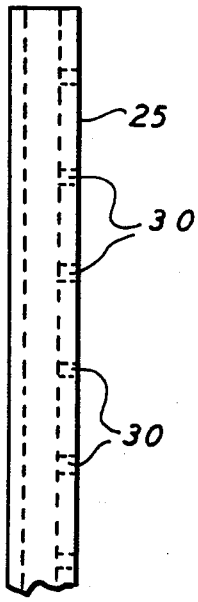
FIG. 6
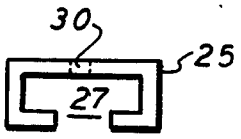

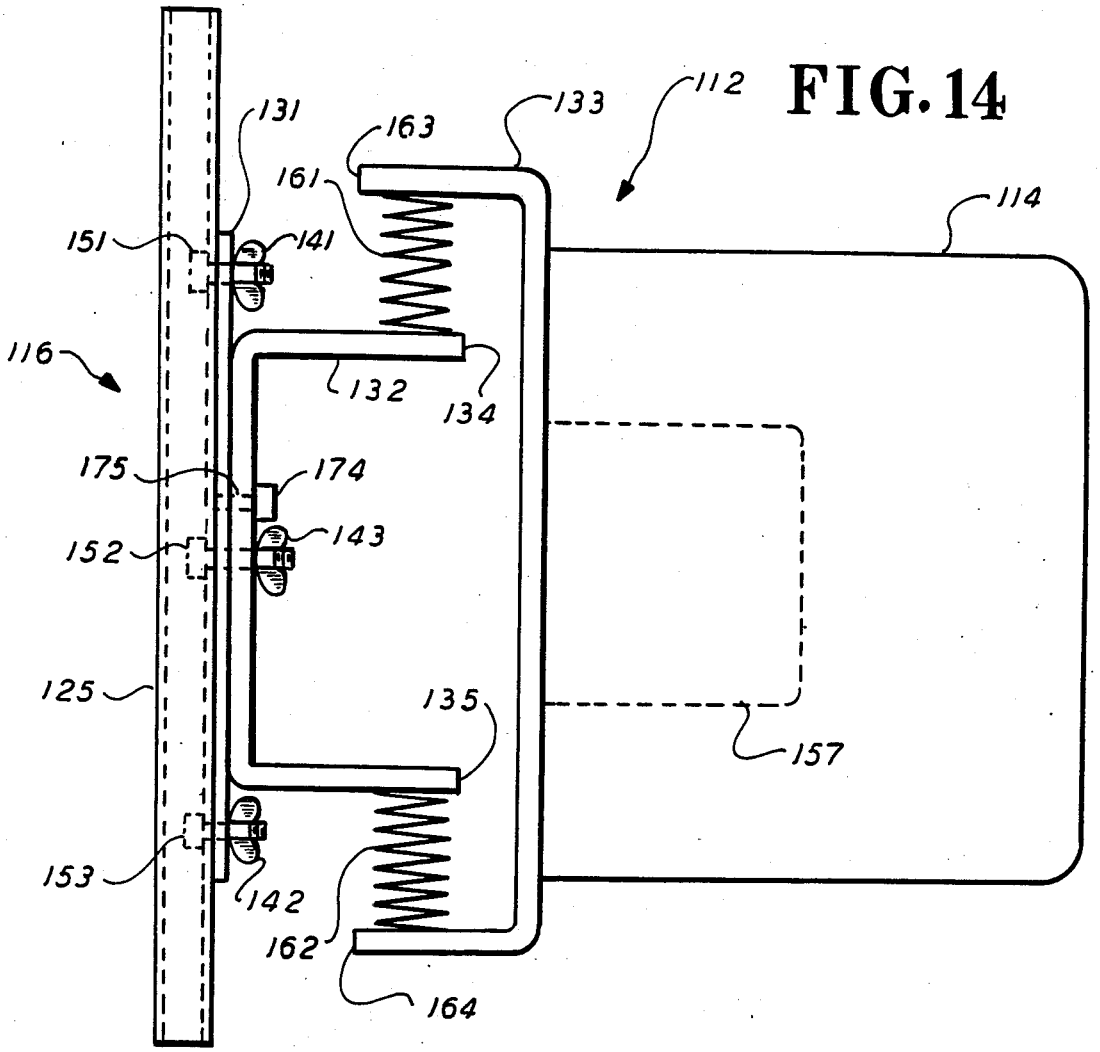
FIG. 14
FIG. 15
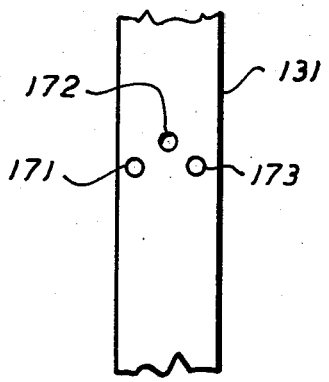
FIG. 16
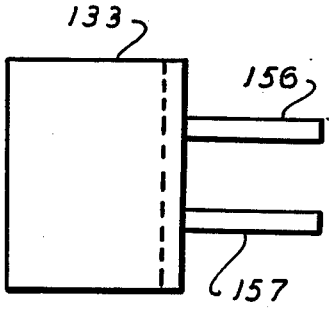

MARTIAL ARTS STRIKING APPARATUS

BACKGROUND OF THE INVENTION

This invention relates generally to new and improved martial arts striking apparatus, and more particularly to new and improved karate kickboard apparatus.

Many different martial arts striking apparatus or devices are known to the prior art, for example punching bag simulators, hitting devices per se, karate board holding and storage devices, and ornamental designs for impact measuring unit for karate training.

Such prior art martial arts striking apparatus may be found, for example, in U.S. Pat. No. 3,927,879 issued Dec. 23, 1975 to Leo E. Long et al. for a punching bag simulator including a spring biased arm pivotally connected to a base on one end and provided on the other end with a deformable pad for striking by the fists, a pair of resilient bumpers are placed between the arm and base and wherein one bumper absorbs kinetic energy of the pivot arm when the arm is moved towards the base and wherein the other bumper absorbs kinetic energy of the pivot arm when the pivot arm is moved away from the base as a result of its spring bias mounting; in U.S. Pat. No. 4,084,811 issued Apr. 18, 1978 to Han Cha Kyo for a hitting device for martial arts including a bellows which may be mounted on a vertical wall and which bellows contracts when struck to absorb the impact of the hitting force and which bellows is provided with closable vents to allow for variation of the compressibility of the bellow thereby varying the resistance to the hitting force by the hitting device; in U.S. Pat. No. 4,173,336 issued Nov. 6, 1979 to Robert W. Perry for striking equipment for developing martial arts skills which includes a striking board of laminated construction including a plurality of layers such as a relatively flexible cushion member for striking with one's hand, which member is supported by a relatively inflexible member which in turn is supported by a relatively inflexible spacing member and a further relatively inflexible member, the latter member being of the constructionn such that the striking board can be held by hand or supported by a bracket support on a wall or other support surface; in U.S. Pat. No. 4,295,646 issued Oct. 20, 1981 to Dereck Squire for a karate board holding and storage device which includes four upright posts assembled together into a rectangular framework having a pair of L-shaped brackets secured to the frontmost opposed posts when the rearmost opposed posts are supported on a vertical supporting surface, a cross bar, connected to the frontmost post and disposed beneath the frontmost pairs of angular L-shaped members, is utilized to retain a vertically disposed board in supported relationship disposed parallel to the supporting surfaces as required to be held during a gymnastic board breaking exercise; in U.S. Pat. No. 4,309,029 issued Jan. 5, 1982 to Steven M. Tomko for a martial arts striking device including a base and at least two arc supports of differing heights resiliently attached in a vertical plane to the base, and a striking area supported on the concave side of the arc supports and adjustable spacers between the arc supports to provide variable tension levels to the arc supports and a back brace supporting the convex side of at least one of the arc supports and at a point on the convex side so to provide maximum stable resistance; and in U.S. Pat. No. Des. 237,869 patented Dec. 2, 1975 to Andrew S. Siroke for the ornamental design for an impact measuring unit for karate training.

As known to those skilled in the art, for desired martial arts striking apparatus use, particularly karate kickboard apparatus for the development of the desired speed timing, accuracy and maximum kicking ability and balance, it is desirable that the striking board, e.g. karate kickboard, be not only resiliently mounted but also able to be mounted at different vertical heights and at different angles with respect to the vertical to better simulate activity that will occur, such as in karate kicking, in actual performance. As is further known to those skilled in the martial arts striking apparatus art, none of the above-noted prior art apparatus provides these features and hence do not provide the desired simulation of martial arts activity desired by those in martial arts traininng or undergoing martial arts practice, particularly those practicing karate kicking. Accordingly, there exists a need in the art for martial arts striking apparatus providing these wanted features.

SUMMARY OF THE INVENTION

The primary object of the present invention is to provide new and useful martial arts apparatus, particularly useful as karate kickboard apparatus, which includes a striking member such as a karate kickboard which not only is mounted resiliently to simulate striking activity, but which is also mounted so as to be able to be positioned at different vertical heights and at different angles with respect to the vertical to better simulate activity that will occur in actual martial arts activity.

Martial arts striking apparatus embodying the present invention and satisfying the foregoing object may include a striking board and mounting means for mounting the striking board at different vertical heights and at different angles with respect to the vertical and for mounting the striking board resiliently whereby the board will pivot in response to a received blow and will thereafter be returned to its initial position.

DESCRIPTION OF THE DRAWINGS

FIG. 3 is an exploded view, in perspective, illustrating the individual structure of various structural elements of the present invention and also illustrating the manner of assembly of such structural elements;

FIGS. 4, 5 and 6 are, respectively, front elevational, side and top views of a structural element of a portion of the mounting apparatus embodied in the martial arts striking apparatus of the present invention;

FIG. 14 is a side elevational view of an alternate embodiment of martial arts striking apparatus embodying the present invention;

FIG. 15 is a partial view of the front of one of the mounting members shown in FIG. 14; and FIG. 16 is a top view of one of the other mounting members shown in FIG. 14.

DESCRIPTION OF THE PREFERRED EMBODIMENT

Figure 1:
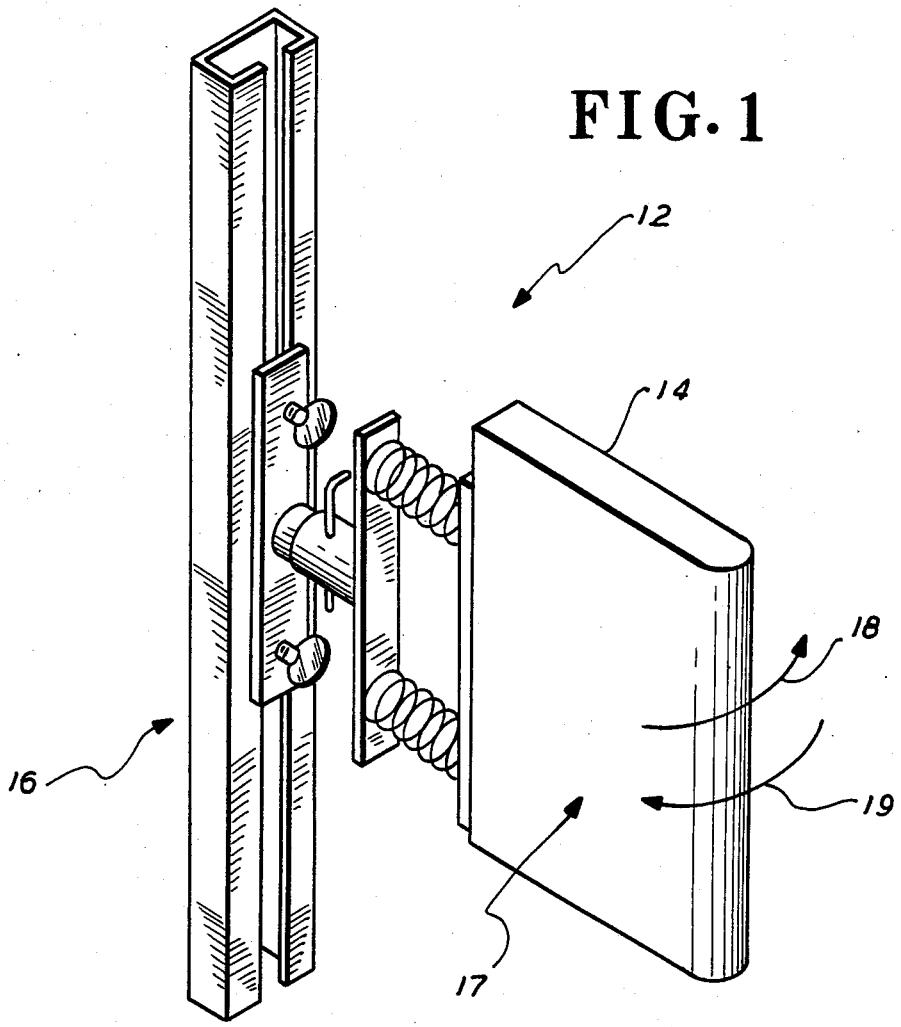
FIG. 1 is a view in perspective of martial arts striking apparatus embodying the present invention.

Referring now to FIG. 1, there is illustrated martial arts striking apparatus embodying the present invention and identified by general numerical designation 12 and which apparatus includes a striking board 14 and mounting apparatus, indicated by general numerical designation 16, for mounting the striking board at different vertical heights and at different angles with respect to the vertical and for mounting the striking board resiliently whereby upon the striking board being struck a blow the resilient means permit the striking board to pivot out of its position in response to the blow as indicated by arrow 18 and whereafter the resilient means returns the striking board to its position as indicated by arrow 19. Martial arts striking apparatus 12 has been found to be particularly useful as karate kickboard apparatus.

Figure 10:
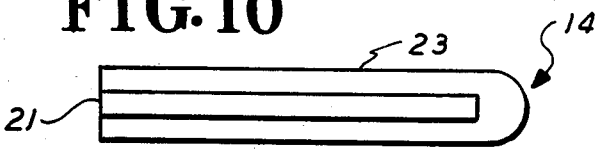
FIG. 10 is a top view of a complete striking board of the present invention.

Detailed structure of an embodiment of striking board 14 is shown in FIGS. 7–10 where it will be understood that the striking board 14 may include a central solid member 21, such as a piece of plywood shaped as shown, and a layer of padding 23, FIG. 10, wrapped around the central solid member 21 in generally U-shaped fashion. The layer of padding may be a layer of foam rubber suitably secured or adhesed to the central solid member 21 by a suitable adhesive, such as for example Elmer's Solvent Contact Cement manufactured by Rexnord Co.

Detailed structure of an embodiment of mounting means of the present invention may be better understood by reference to FIG. 3 where it will be noted that the mounting apparatus or means 16 may include a mounting rack 25, a first mounting member 31, a second mounting member 32, a third mounting member 33, a pair of nuts 28 or 29, a pair of thumb bolts 37 and 38, a generally L-shaped pin 41 and a pair of coil springs 53 and 54.

As may be understood from FIGS. 3 and 4–6, mounting rack 25 is provided with a centrally formed T-track 27 for slidably receiving the nuts 28 and 29 and a plurality of holes 30 for having screws extended therethrough for securing the mounting rack 25 to a suitable vertical support surface such as that provided by a vertical, or substantially vertical, wall.

First mounting member 31 is provided with a pair of holes 42 and 42 for having the thumb bolts 37 and 38, respectively, extended therethrough, and a cylindrical or annular member 45 extending outwardly therefrom and which cylindrical member is provided with a plurality of transverse holes 47 extending therethrough. Similarly, as may be also understood from FIG. 3, second mounting member 32 is provided with a cylindrical member 49 extending therefrom and which cylindrical member 49 is also provided with a plurality of transverse holes 51 extending therethrough. Transverse holes 47 and 51 are dimensioned to permit the L-shaped pin 41 to be inserted therethrough. Springs 53 and 54 are suitably secured to the second and third mounting members 32 and 33 such as by suitable washers and bolts.

Figure 12:
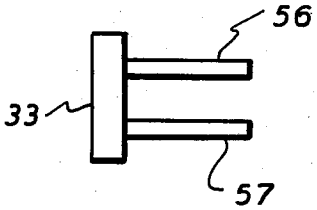
FIGS. 11 and 12 are, respectively, side elevational and top views of a mounting member included in the mounting apparatus of the prsent invention.
Figure 11:
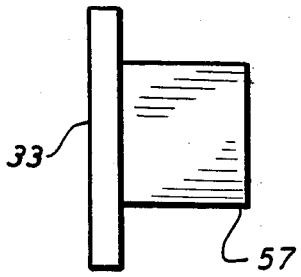
Figure 13:
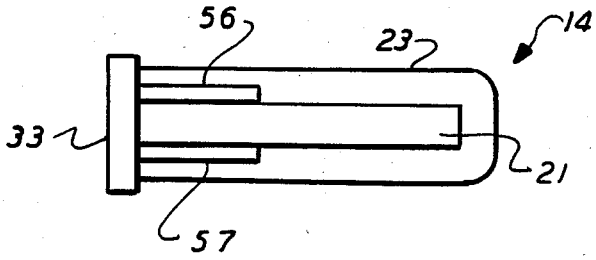
FIG. 13 is a top view of the mounting member of FIGS. 11 and 12 but showing the striking board of FIG. 10 secured thereto.

Third mounting member 33, as shown in FIGS. 3 and 11 and 12, is provided with a pair of outwardly extending, substantially parallel and spaced apart striking board mounting members 56 and 57 for closely receiving, as shown in FIG. 13, the central solid member 21 of the striking board 14 and for having the central member 21, and thereby the striking board 14, secured thereto by a suitable adhesive, such as for example Parabond Adhesive manufactured by Para Chem, Inc.

Figure 2A:
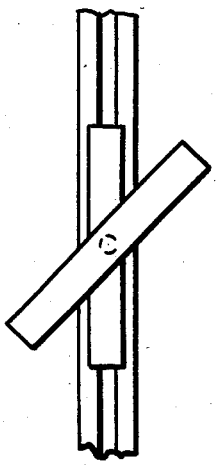
FIGS. 2(*a*), 2(*b*) and 2(*c*) are illustrations of the mounting of a striking board of the present invention at different angles with respect to the vertical.
Figure 2B:
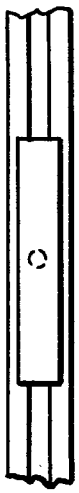
Figure 2C:
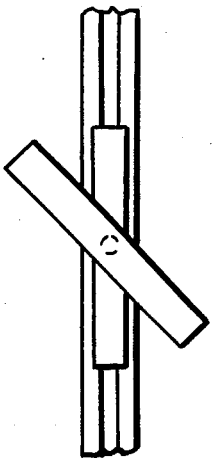
Figure 9:
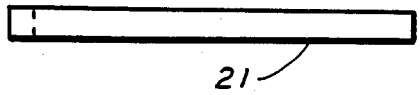
FIGS. 7, 8 and 9 are, respectively, side elevational, edge and top views of the central member of a striking board of the present invention.
Figure 8:
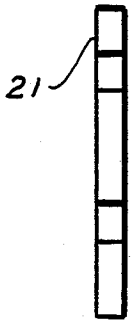
Figure 7:
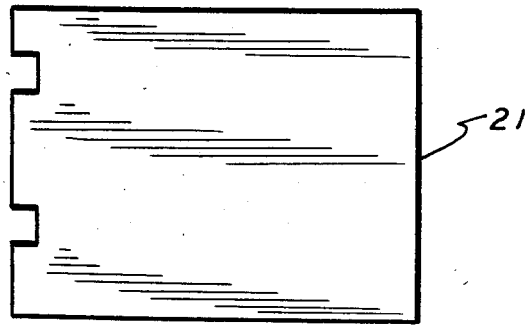

It will not be assumed that the mounting rack 25, FIG. 3, has been suitably secured to a vertical surface as described above whereupon the first mounting member 31 will be secured at a predetermined vertical height to the mounting rack 25 by inserting the thumb bolts 37 through the holes 42 and 43, respectively, formed in first mounting member 31 and thereafter loosely threadedly engaging the nuts 28 and 29, respectively, with the thumb bolts. Thereafter, the assembly of the first mounting member 31, nuts 28, 29 and thumb bolts 37 and 38 will be moved upwardly or downwardly along the mounting rack 25, with the nuts 28 and 29 sliding within the T-track 27 of the mounting rack 25, until the assembly is positioned at a predetermined height whereafter the thumb bolts 37 and 38 will be screwed tightly into the nuts 28 and 29 with sufficient force to frictionally engage the first mounting member 31 with the mounting rack 25. It will further be assumed that the second and third mounting members 32 and 33, coil springs 53 and 54, and the striking board 14 have been assembled and secured togeter as described above. Whereupon, the cylindrical member 49 provided on second mounting member 32, in the embodiment of the invention illustrated in FIG. 3, will be inserted over the cylindrical member 45 provided on the first mounting member 31 and the cylindrical member 49 rotated, and in turn the striking board 14 through the intermediate structure, to the desired predetermined angle with respect to the vertical such as, for example, by being inclined rightwardly as shown in FIG. 2(*a*) or being positioned vertically as shown in FIG. 2(*b*), or inclined to the left as shown in FIG. 2(*c*); it will be understood that the transverse holes 47 and 51 provided in the cylindrical members 45 and 49, respectively, are oriented to provide the desired angular or rotational positions of the cylindrical member 49 and thereby through the intermediate structure of the striking board 14. Upon the desired angle being achieved, the L-shaped pin 41 is inserted through the aligned transverse holes 47 and 51 thereby securing the striking board 14 at the desired angle of striking.

It will be further understood, and referring again to FIG. 13, that upon the striking board 14 being secured to the third mounting member 33, the outer surface of the striking board may be suitably coated, such as by dipping, in a suitable coating material such as 821-Scarlet Vinyl Coating manufactured by the Flexabar Corporation—such coating may be of any desired available color.

Referring now to FIGS. 14–16, and in particular FIG. 14, there is shown a side elevational view of an alternate embodiment of martial arts striking apparatus embodying the present invention and identified by general numerical designation 112. Such apparatus includes a striking board 114 and mounting apparatus, indicated by general numerical designation 116, for mounting the striking board 114 at different vertical heights and at different angles with respect to the vertical and for mounting the striking board resiliently in the same general manner as the striking board 14 of the earlier embodiment; it will be understood that the striking board 114 may be of the same structure as described above with regard to striking board 14.

Referring again to FIG. 14, the mounting apparatus 116 may include a mounting rack 125, a first mounting member 131, a second mounting member 132, a third mounting member 133, wing nuts 141, 142 and 143, threaded bolts 151, 152, 153, and 154 and a pair of oppositely wound torsion springs 161 and 162. The mounting rack 125 is provided with a centrally formed T-track (the same as T-track 27 of the earlier embodiment) for slidably receiving the heads of bolts 151, 152 and 153. It will be understood that the bolts 151, 152 and 153 are for extending through a plurality of holes formed in the first mounting member 132, as shown, and upon the mounting member 131 being positioned along track 125 at a predetermined vertical height, and upon the winged nuts 141 and 142 threadedly engaging the bolts 151 and 153 with sufficiently tight threaded engagement, the first mounting member 131, and hence the striking board 114, is mounted at a predetermined vertical height.

It will be further understood that second mounting member 132 is rotatable with respect to first mounting member 131 and upon the second mounting member 132 being oriented at a predetermined angle with respect to first mounting member 131, and hence with respect to the vertical, and upon the wing nut 143 threadedly engaging the bolt 152 with sufficient threaded frictional engagement, the second mounting member 132, and hence the striking board 114, may be positioned at a predetermined angle with respect to the vertical.

Referring particularly to second mounting member 132 and third mounting member 133, it will be noted that these mounting members are generally U-shaped with the legs 134 and 135 of second mounting member 132 extending outwardly and with the legs 163 and 164 of the third mounting member 133 extending inwardly. The respective pairs of legs of the second and third mounting members 132 and 133, as shown, are aligned vertically and it will be further understood as shown that the first torsion spring 161 extends between and is secured to leg 134 of second mounting member 132 and leg 163 of third mounting member 133; similarly, second torsion spring 162 extends between and is secured to leg 135 of second mounting member 132 and leg 164 of third mounting member 133; it will be understood that such torsion springs may be suitably secured to such respective legs as by welding, nuts and bolts, etc. in the manner known to those skilled in the art. It will be further understood that the torsion springs 161 and 162 mount the striking board 114 resiliently whereby upon the striking board 114 being struck a blow the torsion springs 161 and 162 permit the striking board 114 to pivot out of its position in response to the blow as indicated by the arrow 18 of FIG. 1 and whereafter the torsion springs 161 and 162 return the striking board 114 to its original position as indicated by the arrow 19 of FIG. 1.

Referring now to FIGS. 14 and 16, particularly FIG. 16, it will be noted that the third mounting member 133 is provided with a pair of spaced apart striking board mounting members 156 and 157 for the same purposes as the striking board mounting members 56 and 57 of FIGS. 3, 12 and 13.

Referring now to FIG. 15, it will be understood that to assist the bolt 152 and wing nut 143 in mounting the second mounting member 132 and hence the striking board 114 at different predetermined angles with respect to the vertical, the mounting member 131 may be provided with a plurality of arcuately arranged or disposed holes 171, 172 and 173 extending therethrough as shown in FIG. 15. Second mounting member 132 is provided with a hole 175 extending therethrough (FIG. 14), and it will be understood that upon the second mounting member 132 being positioned at a predetermined angle with respect to the vertical, hole 175 will overlie one of the threaded holes 171, 172 or 173 whereupon the threaded bolt 174 will be extended through the hole 175 to threadedly engage one of the threaded holes 171, 172 or 173 and thereby further assist in positioning the second mounting member 132, and hence the striking board 114, at a different angle with respect to the vertical.

It will be further understood that striking board 114 may be secured to the third mounting member 133 and the striking board mounting members 156 and 157 as the striking board 14 of the earlier embodiment is secured to third mounting member 33 and striking board mounting members 56 and 57, whereafter it will still be further understood that the outer surface of the striking board 114 may be suitably coated as described above with regard to striking member 14.

As taught above with regard to martial arts striking apparatus 12, it has been found that martial arts striking apparatus 112 is also particularly useful as karate kickboard apparatus.

It will be further understood by those skilled in the art that many variations and modifications may be made in the present invention without departing from the spirit and the scope thereof.

What is claimed is:

1. New and improved martial arts striking apparatus, comprising:

a generally planar striking board;

mounting means for mounting said generally planar striking board perpendicular to and rotatably with respect to a vertical plane at predetermined different vertical heights with regard to said vertical plane and rotatable about an axis perpendicular to said vertical plane at predetermined different angles with respect to said vertical plane, said mounting means including resilient means and upon said striking board being mounted in a predetermined position and upon said striking board being struck a blow, said resilient means first for permitting said striking board to pivot out of said predetermined position in response to said blow and thereafter said resilient means for returning said striking board to said predetermined position;

said mounting means further including a mounting rack of predetermined length provided with a centrally formed and vertically extending T-track and for being secured to a generally vertical surface, a first mounting member provided with a plurality of holes extending therethrough, a plurality of nuts and a plurality of thumb bolts, said nuts for being received slidably within said T-track at said predetermined different vertical heights and said thumb bolts for extending through said holes provided in said first mounting member and for threadedly engaging said nuts, and upon said thumb bolts sufficiently tightly threadedly engaging said nuts at one of said predetermined different vertical height, said first member being secured to said mounting rack at said one of said predetermined different vertical heights; and said mounting mean further including a second mounting member for being positioned opposite said first mounting member and a generally L-shaped pin, said first and second mounting members each provided with a generally cylindrical member and extending towards the other cylindrical member, said cylindrical members each provided with a plurality of transverse holes extending therethrough and at least one of said cylindrical members being a hollow cylindrical member dimensioned to permit the other of said cylindrical members to be slidably and rotatably received therein, upon the other of said cylindrical members being received in said one cylindrical member and upon predetermined holes in each of said cylindrical members being aligned, and upon said generally L-shaped pin being extended through said aligned holes, said second mounting member being positioned at one of said predetermined different angles with respect to said vertical plane.

2. Martial arts striking apparatus according to claim 1 wherein said mounting means further comprise a third mounting member for being positioned opposite said second mounting member and a plurality of coiled springs extending between said second and third mounting members with their opposite ends secured to said second and third mounting members, said springs comprising said resilient means.

3. New and improved martial arts striking apparatus, comprising:

a generally planar striking board;

mounting means for mounting said generally planar striking board perpendicular to and rotatably with respect to a vertical plane at predetermined different vertical heights with regard to said vertical plane and rotatable about an axis perpendicular to said vertical plane at predetermined different angles with respect to said vertical plane, said mounting means including resilient means and upon said striking board being mounted in a predetermined position and upon said striking board being struck a blow, said resilient means first for permitting said striking board to pivot out of said predetermined position in response to said blow and thereafter said resilient means for returning said striking board to said predetermined positions; and said mounting means further including a first mounting member for being mounted to a generally vertical surface, a second generally U-shaped mounting member secured to said first mounting member and having a pair of outwardly extending legs, a third generally U-shaped mounting member having a pair of inwardly extending legs, and a pair of oppositely wound torsion springs, said pairs of legs aligned vertically, one of said torsion springs residing between and secured to one leg of each pair of legs and the other torsion spring residing between and secured to the other leg of each pair of legs, said torsion springs providing said resilient means.

4. Martial arts striking apparatus according to claim 3 further including a mounting rack of predetermined length provided with a centrally formed T-track and for being secured to said generally vertical surface, said first mounting member for being mounted to said generally vertical surface by said mounting rack and provided with a plurality of holes extending therethrough, said mounting means further including a plurality of threaded bolts and a plurality of wing nuts, said bolts for being received slidably within said T-track at said predetermined vertical heights and for extending outwardly through said holes provided in said first mounting member and for threadedly engaging said wing nuts, and upon said wing nuts sufficiently tightly threadedly engaging said bolts at one of said predetermined different vertical heights, said first mounting member being secured to said mounting rack at said one of said predetermined different vertical heights.

5. Martial arts striking apparatus according to claim 1 wherein said first mounting member is further provided with a plurality of arcuately disposed threaded holes extending therethrough, wherein said second mounting member is provided with a further additional hole extending therethrough and wherein said mounting means further include a still further additional threaded bolt upon said second mounting member being oriented with respect to said first mounting member at one of said predetermined different angles as said, said further additional hole formed in said second mounting member overlying one of said threaded holes extending through said first mounting member whereupon said still further additional threaded nut is for extending through said further additional hole and threadedly engaging said one threaded hole to further secure said second mounting member to said first mounting member at one of said predetermined different angles.

6. Martial arts striking apparatus according to claim 4 wherein said second mounting member is for being secured to said first mounting member at said predetermined different vertical angles by an additional bolt residing slidably within said T-track and extending through an additional hole formed generally centrally of said second mounting member and an additional wing nut, upon said second mounting member being oriented with respect to said first mounting member at one of said predetermined different angles, and upon said additional wing nut sufficiently tightly threadedly engaging said additional bolt, said second mounting member being secured to said first mounting member at one of said predetermined different angles with respect to the vertical.

7. Martial arts striking apparatus according to claim 2 or 3 wherein said third mounting member is provided with at least a pair of outwardly extending, substantially parallel and spaced apart striking board mounting members for receiving a predetermined portion of said striking board therebetween and for having said striking board secured thereto.

8. Martial arts striking apparatus according to claim 2 or 3 wherein said striking board is of laminated construction including a central solid member and a layer of padding wrapped around said solid member in generally U-shaped fashion, said layer of padding secured to said solid member, and wherein said third mounting member is provided with at least a pair of outwardly extending, substantially parallel and spaced apart striking board mounting members for receiving said central solid member therebetween and for having said striking board secured thereto.

* * * * *

UNITED STATES PATENT AND TRADEMARK OFFICE

CERTIFICATE OF CORRECTION

PATENT NO. : 4,662,630

DATED : May 5, 1987

INVENTOR(S) : Michael J. Dignard and Paul C. Roberts

It is certified that error appears in the above-identified patent and that said Letters Patent are hereby corrected as shown below:

Column 1, line 42, change "structionn" to --struction--;

Column 2, line 17, change "traininng" to --training--;

Column 2, line 65, change "prsent" to --present--;

Column 3, line 44, change "or" to --and--;

Column 3, line 56, change "42" (second occurrence) to --43--;

Column 4, line 32, change "togeter" to --together--;

Column 7, line 3, change "height" to --heights--;

Column 7, line 52, change "positions" to --position--;

Column 8, line 16, change "1" to --6--;

Column 8, line 48, change "the vertical" to --said vertical plane--.

Signed and Sealed this

Eighteenth Day of August, 1987

*Attest:*

*Attesting Officer*

DONALD J. QUIGG

*Commissioner of Patents and Trademarks*